United States Patent [19]

Homs

[11] 4,064,651

[45] Dec. 27, 1977

[54] PIVOTED WINDOW

[76] Inventor: Juan Puigdomenech Homs, Calle Padre Huix, 1, VIC Barcelona, Spain

[21] Appl. No.: 647,915

[22] Filed: Jan. 9, 1976

[30] Foreign Application Priority Data

Jan. 15, 1976 Spain ..... 209532

[51] Int. Cl.[2] ..... E06B 7/205

[52] U.S. Cl. ..... 49/319; 49/394

[58] Field of Search ..... 49/163, 168, 62, 63, 49/67, 317, 319, 316, 321, 394

[56] References Cited

FOREIGN PATENT DOCUMENTS

| | | | |
|---|---|---|---|
| 1,395,484 | 3/1965 | France | 49/316 |
| 382,025 | 9/1964 | Switzerland | 49/319 |

*Primary Examiner*—Kenneth Downey
*Attorney, Agent, or Firm*—Steinberg & Blake

[57] ABSTRACT

A pivoted window frame is disclosed having an outer fixed frame and an inner pivotable frame together with a pivotable channel guide for a blind. An actuating mechanism on the movable frame can act to lock the movable frame in a closed position in the outer frame together with the channel guide or to release the movable frame for movement with or without the channel guide. The drive mechanism also actuates means for determining any one a plurality of pivoted positions of the movable frame and a sealing mechanism for urging resilient sealing lips into contact with the movable frame only when it is in its closed position.

7 Claims, 8 Drawing Figures

FIG. 5
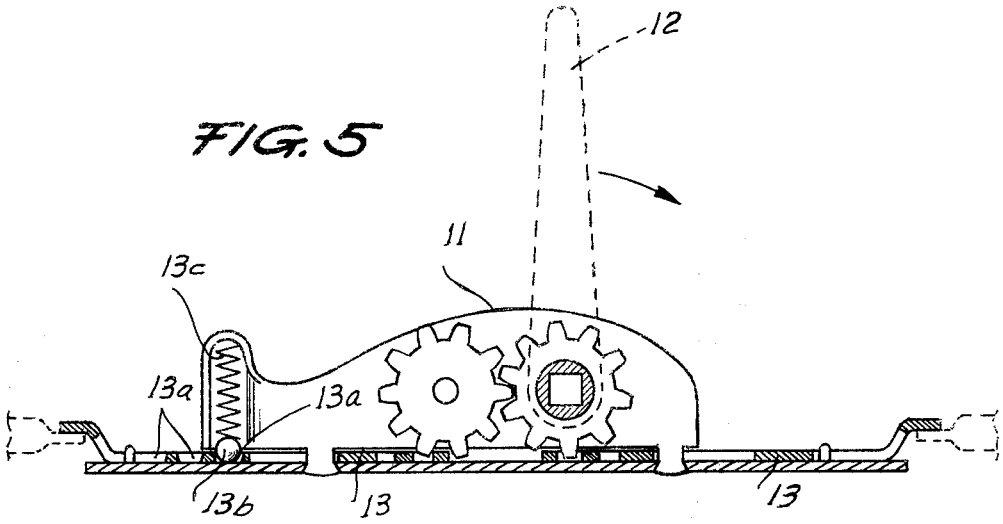
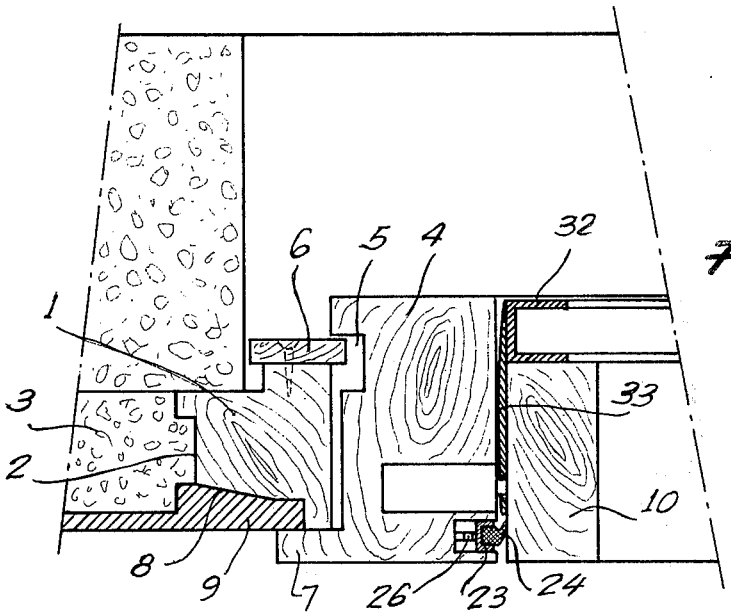
FIG. 8

PIVOTED WINDOW

FIELD OF THE INVENTION

The present invention relates to a pivoted window which can open in both directions that is to say both inwards and outwards.

BACKGROUND OF THE INVENTION

There has previously been proposed in Spanish Utility Model No. 190,736 a pivoted window comprising a fixed frame to which is articulated a movable frame pivotable to both sides of the fixed frame, and also a channel guide for a roller blind adapted to move together with the movable frame or to remain fixed, wherein the movable frame is provided with means for predetermining and fixing at least one inclined position, the said means being adapted to be operated by means of a drive device which at the same time acts on a device for locking the movable frame in its closed position, which is a bolt locking means whose bars project laterally outwardly so as to be received in cavities provided in the fixed frame.

SUMMARY OF THE INVENTION

In practice it has been found that the pivoted window forming the object of Utility Model No. 190,736 was capable of certain improvements, and these form the object of the present invention. These improvements relate essentially to the drive means and mechanism intended to effect the movement and also the fixing of the movable frame and the channel guide for the blind. They also aim at achieving hermetic closure of the window, by means operable in synchronism with the drive device.

Thus wings fixed to a part of the blind guide remote from the pivot and provided with apertures adapted to come into alignment with ends of the closure bars of the bolt locking means when the guide and the frame are in adjacent positions, so that the said bars can pass through the said apertures, thereby constraining the blind guide to move with or be stationary with the pivoting frame.

A sealing mechanism may be provided in the fixed frame which comprises at least one articulated lever bearing at one of their ends on a strip carrying elastic lip adapted to be applied under pressure against the movable frame when in its closed position and to be moved away from the movable frame, the lever being operated by the end of the bar of the bolt locking mechanism.

The lever may be linked to a displaceable element acted on by the end of the bar of one bolt locking mechanism, and the displaceable element may be urged towards the end of the bar of the bolt locking means, and at the same time comprise projecting latches subjected to pressure by spring means and tending to project outside and enter the aperture in the wing of the blind guide, thereby to lock the latter against movement.

Furthermore, the bolt locking means may be provided with a fastening device which biases it into various predetermined positions, corresponding to locking of the movable frame and the channel guide or to release of the movable frame with and without the channel guide respectively.

This device preferably is a ball elastically pressed against a series of apertures formed in one of the bars.

Provision has also been made for the fixed frame to be mounted against a pre-mounted frame fixed in the structure, the whole arrangement being completed by moulding or beads for finishing purposes.

DESCRIPTION OF THE DRAWINGS AND OF THE EMBODIMENT

In the accompanying drawings one practical embodiment of the invention is illustrated solely by way of example, and in which:

FIG. 5 is a detail of the bolt locking means;

FIG. 8 is a cross-section showing the joining of the fixed frame to a first frame disposed in the structure.

Figure 1:
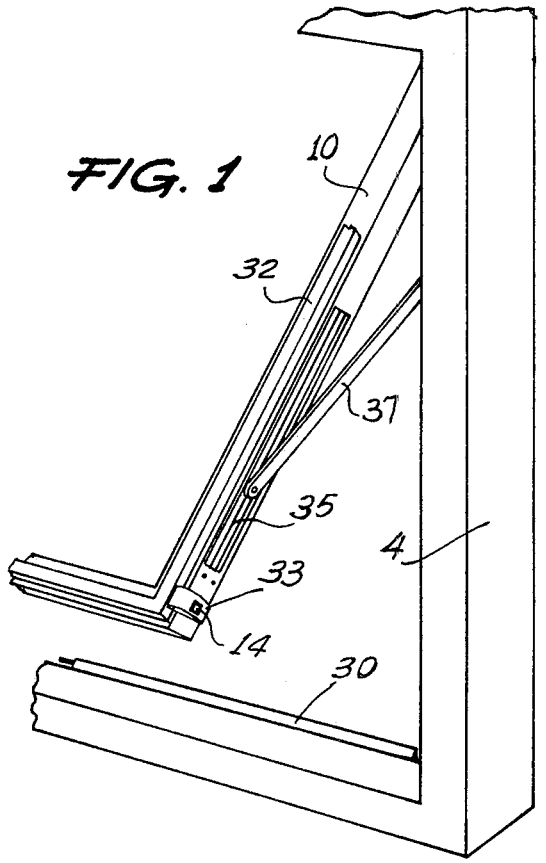
FIG. 1 is a view in perspective of the open window.

The window described and illustrated in the drawings consists of a premounted frame 1 provided with an internal rabbet 2 which has been fastened to a wall of a building structure 3. To this frame is secured a fixed frame 4 having a rabbet 5 to receive a bead 6 fixed to the frame 1. The frame 4 has a front flange 7 which is partly superimposed on a rabbet 8 in the frame 1, which rabbet is filled with a covering 9 of plaster or the like (FIG. 8).

On the top part of the frame 4 is transversely articulated a movable frame 10, on the bottom part of which is mounted a bolt locking device 11 operated by a crank 12. The locking device in question comprises two axially movable bars 13, whose ends 14 project to the outside of the movable frame and are adapted to penetrate into cavities 15 provided in the frame 4. One of the bars is equipped with three openings **13*a* adapted to receive a ball 13*b* to which pressure is applied by a spring 13*c* (FIG. 5**).

Figure 2:
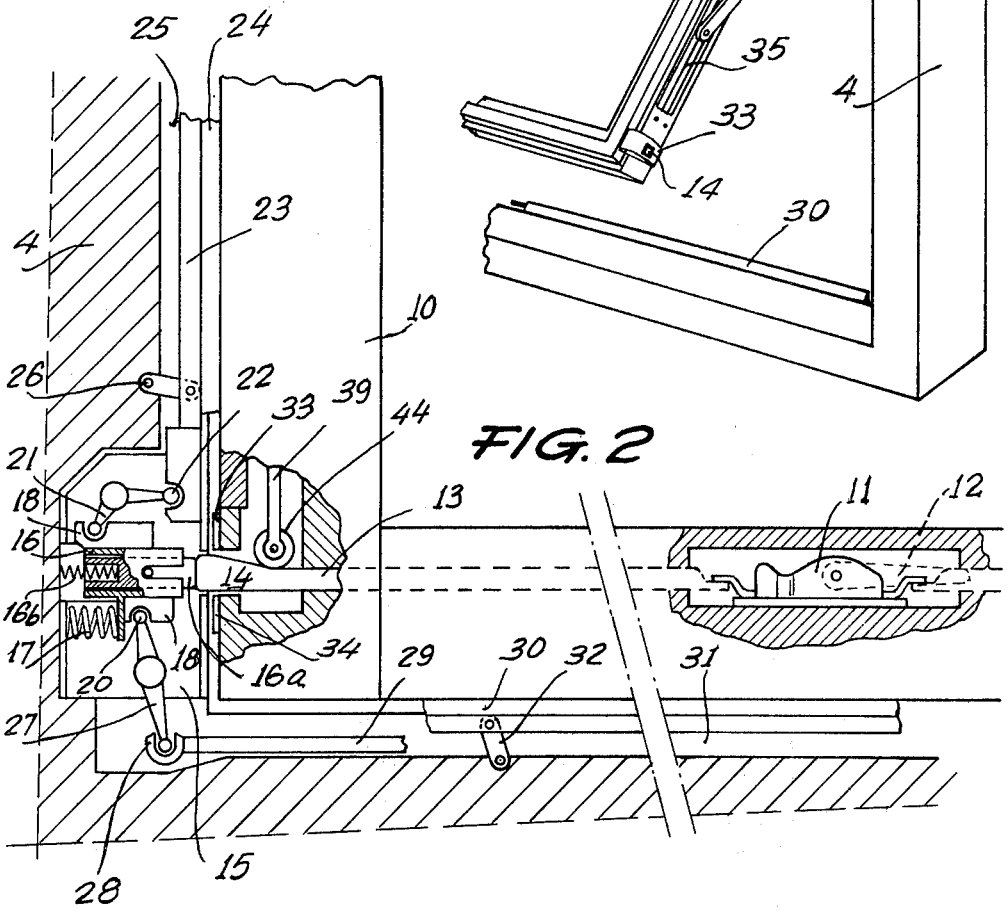
FIG. 2 is a detail in longitudinal section showing the window closing mechanism and the mechanism operating the elastic lips, in the closed position.

On both sides of the frame 4, at the bottom part of the latter, are situated two movable elements 16 to which pressure is applied by springs 17 and which are situated facing the respective ends 14 of the bars 13. Inside these elements are mounted latches **16*a* to which pressure is applied by springs 16*b* tending to hold the elements 16*a* supported against the ends 14 (FIG. 2). One of the elements 16 carries wings 18 having two curved recesses 19 and 20. On the first of these is articulated one end of a bent lever 21, whose opposite end lies in a recess 22 provided in the end of a strip 23 carrying an elastic lip 24 received in a longitudinal groove 25 provided along the sides of the frame 4, the said strip being mounted on small articulated levers 26 situated inside the groove 25**.

The recess 20 receives one end of a lever 27 whose opposite end lies in a recess 28 formed in the end of a strip 29 carrying an elastic lip 30, which moves in a recess 31 provided along the bottom side of the frame 4, the said strip being mounted on small levers 32 situated inside the groove 31.

Although the drawings show a set of two levers 21 and 27 articulated on the slide, it is possible to provide a single lever and to join the strips 23 and 29 so that they move in unison. With regard to the opposite side of the window, a conventional articulation will be provided which is operated by the correspondng slide so as to act on a strip provided with an suitable elastic lip.

On the top part of the frame 4 is transversely articulated a channel guide 32 for roller blind, to the sides and bottom part of which guide are connected two wings 33 provided with apertures 34 adapted to come into alignment with the ends 14 of the bars 13, when the guide and the movable frame are situated in adjacent positions, and with the latches 16*a* which are adapted to penetrate into the apertures 34.

Figure 4:
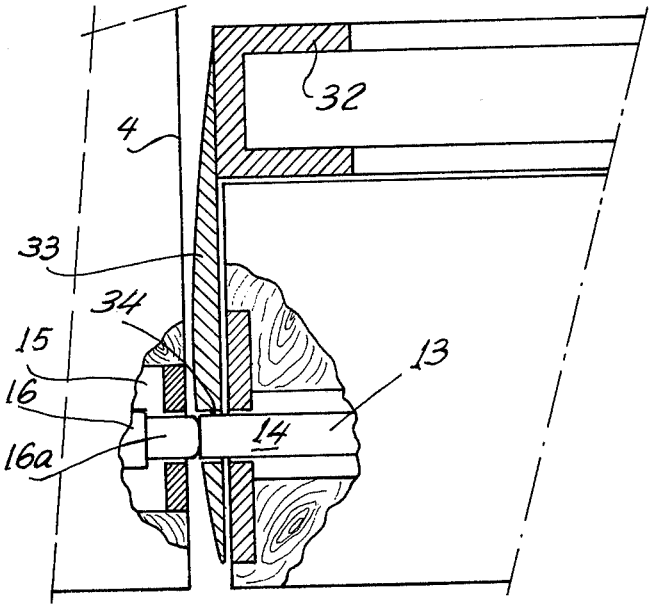
FIG. 4 is a detail in cross-section showing the locking device.
Figure 6:
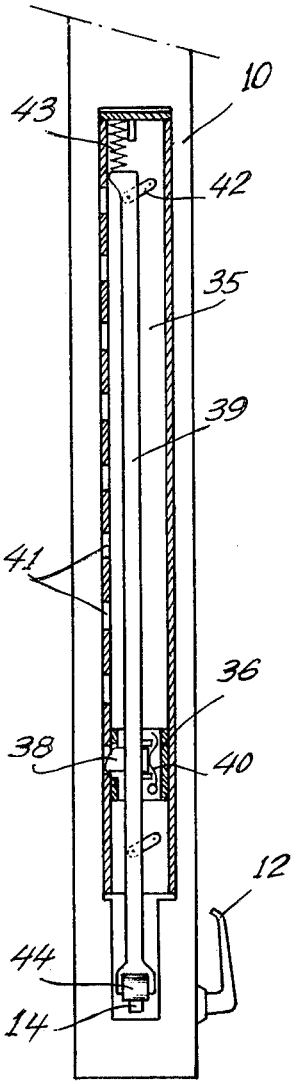
FIG. 6 is a longitudinal section of the mechanism for adjusting and securing the open positions of the oscillating frame.

On one of the sides of the frame 10 is provided a longitudinal guide 35 along which slides a slide 36 on which is articulated one end of a compass arm 37 whose opposite end is articulated on the frame 4 (FIGS. 1 and 4). Inside the slide 36 is mounted a latch 38, through which passes a rod 39 and to which pressure is applied by a spring 40 in the direction of a series of apertures 41 which constitute optional recesses for the latch 38.

The rod 39 is articulated to a pair of small parallel arms 42, which in turn are articulated on the inner face of the guide 35 and permit lateral displacement of the rod and consequently of the latch 38 in the direction of or away from the apertures 41. A spring 43 bears against the upper end of the rod, while on the other end there is provided a loose roller 44, which constitutes a point of support for the rod on the end 14 of the bar 13 of the bolt locking means 11.

Figure 3:
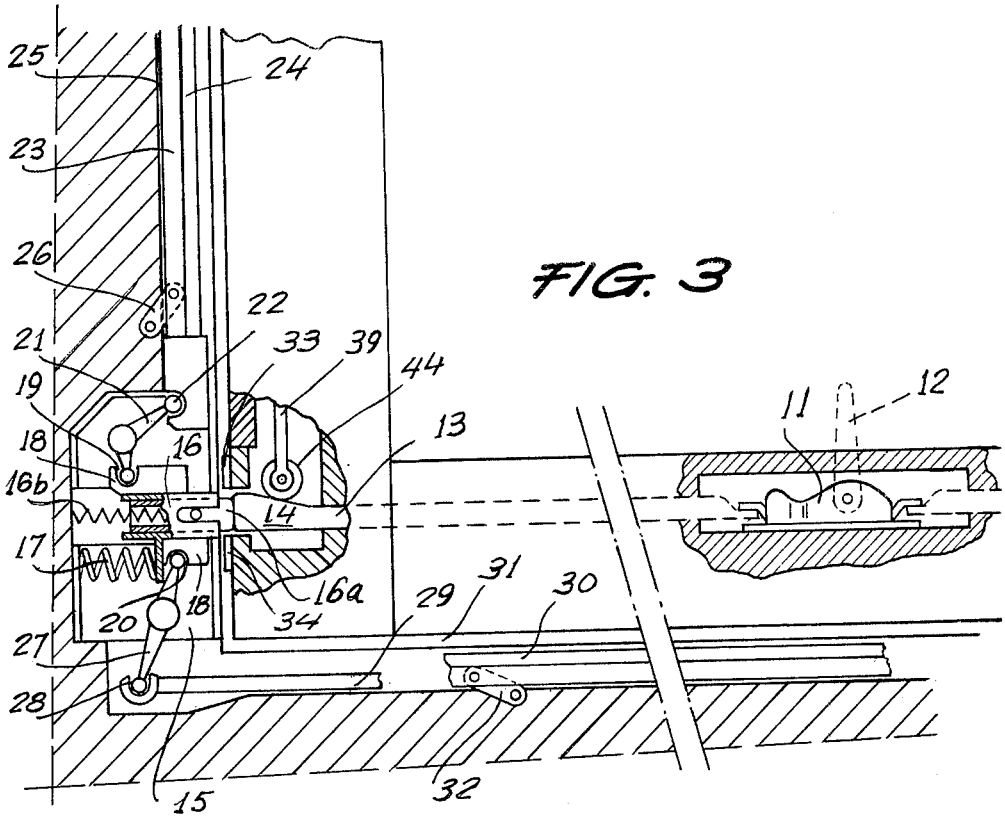
FIG. 3 is a similar view in the open position.
Figure 7:
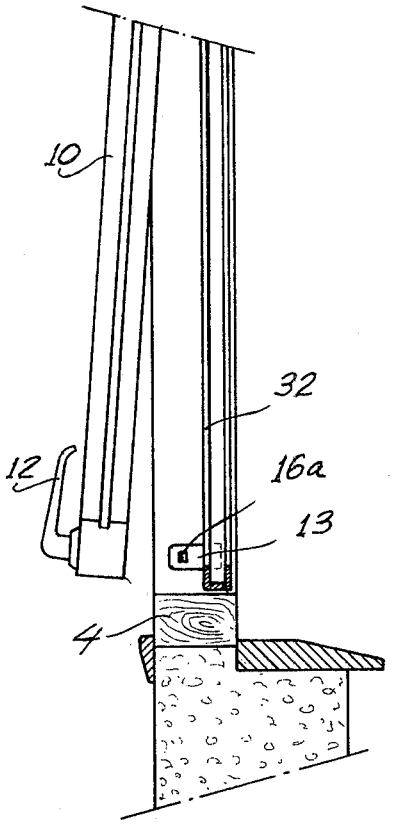
FIG. 7 is a view in elevation showing the movable frame opened in the inward direction.

From the above description it is possible to understand the operation of the window, which is as follows:

By operating the crank 12 the bars 13 are moved through the bolt locking means 11 and it is thus possible for the ends 14 of the said bars to be retracted or else received in the cavities 15 in the fixed frame 4, whereby the oscillating frame is locked. Furthermore, since the channeled frame 32 is situated in a position adjacent to the movable frame 10, the end 14 passes through the aperture 34 of each wing 33, thus locking the channeled frame 32 together with the movable frame (FIG. 2). In order to open the window it is sufficient to operate the crank 12, thereby retractig the ends 14 and enabling the movable frame to be oscillated forwards or backwards (FIG. 3). It is also possible to oscillate the movable frame 10 towards the inside while nevertheless the guide 32 remains locked by the latches 16*a* which penetrate into the apertures 34 in the wings 33 (FIG. 7). By placing the crank 12 in an intermediate position, the end 14 of the bars will be caused to lie in the same plane as the aperture 34 in the wings 33 (FIG. 4), so that it prevents the penetration of the latch 16*a*, and the frame 10 and the guide 32 can swing freely forwards or backwards.

In the closed position (FIG. 2) the ends 14 of the bars 13 apply pressure to the elements 16 and then 16*a*, so that the levers 21 and 27 force the sections 23 and 29 to remain in the raised position with their respective elastic lips 24 and 30 lying against the frame 10. On operation of the crank 12 the ends 14 are retracted and the springs 17 force the elements 16 and 16*a* to move and operate the levers 21 and 27, which in turn act on the sections 23 and 29, which are displaced on the small levers 26 and 32, retracting and moving the lips 24 and 30 away from the frame 10. In this manner, when the window is closed the elastic lips 24 ensure perfect fitting of the window and, when it is opened, they move away automatically in order not to impede the oscillating movements.

Finally, the ends 14 of the bars 13 act as cams, since they transmit the closing or opening movement through the roller 44 to the rod 39, to which pressure is applied by the spring 43 urging it into a position close to the row of apertures 41, so that the latch 38 can enter the latter in succession, thus providing a corresponding number of fixed positions of the movable frame. When the crank 12 is operated in the opening direction, the end 14 applies a thrust to the rod 39, which moves away from the apertures, so that the latch 38 is completely free.

The positions of the crank are fixed by means of the ball 13*b* engaging the apertures 13*a*, thereby preventing the accidental displacement of the closure means.

To sum up, with a single drive means, that is to say with the crank 12, it is possible to close the oscillating frame 10 and secure it together with the channeled frame 32, to free it for movement with or without the channeled frame 32, to act automatically on elastic lips and seals 24, and to free or place in the working position a latch 38 intended to secure the angular positions of the movable frame 10.

All this is achieved with a degree of simplicity which enables the construction and operation of the window.

I claim:

1. In a pivoted window comprising a fixed frame to which is articulated a movable frame pivotable to both sides of the fixed frame, and also a channel guide for a roller blind adapted to move together with the movable frame or to remain fixed, wherein the movable frame is provided with means for predetermining and fixing at least one inclined position, the said means being adapted to be operated by means of a drive device which at the same time acts on a device for locking the movable frame in its closed position, which is a bolt locking means whose bars project laterally outwardly so as to be received in cavities provided in the fixed frame, the improvement comprising wings fixed to a part of the blind guide remote from the pivot and provided with apertures adapted to come into alignment with ends of the closure bars of the bolt locking means when the guide and the frame are in adjacent positions, so that the said bars can pass through the said apertures, thereby constraining the blind guide to move with or be stationary with the pivoting frame, a sealing mechanism being provided in the fixed frame which comprises at least one articulated lever bearing at one of their ends on a strip carrying elastic lip adapted to be applied under pressure against the movable frame when in its closed position and to be moved away from the movable frame, the lever being operated by the end of the bar of the bolt locking mechanism, said lever being operatively linked to a displaceable element acted on by the end of the bar of the bolt locking mechanism, the displaceable element being urged toward the end of the bar of the bolt locking means, and comprising a projecting latch subjected to pressure by spring means and tending to project outside and enter the aperture in the wing of the blind guide, thereby to lock the latter against movement.

2. A pivoted window comprising an outer frame an inner frame within the outer frame, pivot means mounting the inner frame pivotably on the outer frame, a frame for a blind, pivot means mounting the blind frame pivotably relative to the outer frame and the inner frame, bolt means on the inner frame, a drive mechanism on the inner frame operatively linked to the bolt means, at least one aperture in the outer frame for receiving the bolt means, means bearing at least one aperture on the blind frame, the said means being positionable between the inner frame and the outer frame whereby the two said apertures are alignable in a closed position of the inner frame, means for determining at least one open, inclined, position of the inner frame, the said determining means being operable by the said drive mechanism.

3. A pivoted window according to claim 2 wherein the bolt locking means is equipped with a detent device biasing it towards various predetermined positions.

4. A pivoted window according to claim 3 wherein the said predetermined positions correspond to at least a withdrawn position of the bolt means into the inner frame, an intermediate position in which the bolt means projects by an amount to enter only the aperture on the blind frame and a fully projecting position in which the bolt means project by an amount to enter the two said apertures.

5. A pivoted window according to claim 4 wherein a latch is urged inwards from the outer frame and tending to penetrate into the apertures provided in the means on the blind frame, which latch is adapted to be pushed into retracted positions by the bolt means in its said intermediate and fully projecting positions.

6. A pivoted window according to claim 3 wherein a latch is urged inwards from the outer frame and tending to penetrate into the apertures provided in the means on the blind frame, which latch is adapted to be pushed into retracted positions by the bolt means.

7. A pivoted window according to claim 2 wherein the outer frame is joined to a premounted frame fixed in advance to the structure, mouldings being provided and fitting in rabbets provided for the purpose.

* * * * *